US005618035A

United States Patent [19]

Coombs et al.

[11] Patent Number: 5,618,035

[45] Date of Patent: Apr. 8, 1997

[54] OFFSET STACKER

[75] Inventors: Peter M. Coombs, Tustin; Bradford Billings, Lake Forest, both of Calif.

[73] Assignee: Gradco (Japan) Ltd., Tokyo, Japan

[21] Appl. No.: 344,910

[22] Filed: Nov. 25, 1994

[51] Int. Cl.[6] ..... B65H 31/00

[52] U.S. Cl. ..... 271/213; 414/791.2; 414/926; 271/217

[58] Field of Search ..... 271/213, 214, 271/215, 217; 414/791.2, 926

[56] References Cited

U.S. PATENT DOCUMENTS

| | | | |
|---|---|---|---|
| 4,382,592 | 5/1983 | Harping et al. | 270/33 |
| 4,687,193 | 8/1987 | Scarabino et al. | 414/791.2 X |
| 4,865,308 | 9/1989 | Krasik | 271/213 |
| 4,981,293 | 1/1991 | Yamashita et al. | 271/213 X |
| 4,989,853 | 2/1991 | Matysek et al. | 414/791.2 X |
| 5,007,625 | 4/1991 | Kremers et al. | 271/213 X |
| 5,037,081 | 8/1991 | Engelhardt et al. | 271/213 X |
| 5,056,774 | 10/1991 | Kubota et al. | 271/213 |
| 5,350,169 | 9/1994 | Hiroi et al. | 271/213 |

FOREIGN PATENT DOCUMENTS

| | | | |
|---|---|---|---|
| 3-26655 | 2/1991 | Japan | 271/213 |
| 1256289 | 12/1971 | United Kingdom . | |

OTHER PUBLICATIONS

IBM Technical Disclosure Bulletin vol. 17, No. 8, Jan., 1975.

*Primary Examiner*—Karen B. Merritt
*Assistant Examiner*—Scott L. Lowe
*Attorney, Agent, or Firm*—Newton H. Lee, Jr.

[57] ABSTRACT

A self-contained offset stacker tray assembly is operable in conjunction with the sheet output of a host printer or copier to receive sheets from the host machine and deposit the sheets in offset sets. The assembly includes a supporting base for a frame structure reciprocable transversely of the direction of sheet infeed from the host and containing a receiver tray, infeed rolls to supply sheets to the trays, a rotary cam mechanism for shifting the frame assembly relative to the output from the host machine and the receiver tray being vertically movable within the frame structure and biased upwardly by counter balancing springs to be moved downwardly as the weight of the sheets in the tray increases.

6 Claims, 4 Drawing Sheets

OFFSET STACKER

BACKGROUND OF THE INVENTION

Various stacker tray devices are known for the purpose of receiving and stacking sheets of paper exiting the usual office printer or copier wherein the receiver tray is adapted to be moved downwardly by relatively complex sheet detecting and stack height detecting mechanical drive systems.

In addition, various offsetting mechanisms are known for purposes of enabling a stacker tray, or other trays such as in sheet sorting machines, to receive sets of documents on the tray but positioned in offset relation to one another so as to facilitate set separation.

Detection of stack height and lowering of the stacker tray is shown, for example, in U.S. Pat. No. 5,350,169 granted Sep. 27, 1994.

Offsetting of the sheet sets has heretofore been accomplished in a number of ways including relatively angularly displacing the sets as shown in U.S. Pat. No. 4,382,592 granted May 10, 1983, by gripping a sheet between feed rolls which are shifted transverse of the direction of sheet feed. As shown in British patent 1256289 published Dec. 8, 1971 the sheet gripping rolls are shifted by a cam mechanism between a center position and alternate positions left and right of center.

In addition, in IBM Technical Disclosure Bulletin Vol. 17 No. 8 dated Jan. 8, 1975, at page 2255 there is disclosed a sheet stacking platformto which sets of sheets are supplied by a sheet feeder wherein the platform is supported for movement transverse of the sheet feeding direction upon rotation of a cam so as to offset the sets of sheets.

SUMMARY OF THE INVENTION

The present invention involves the provision of a self contained sheet receiver or stacker adapted to be mounted or positioned adjacent to the sheet output from a host printer or copier.

More particularly, the invention provides a simple structure for receiving sheets and when required to offset sets of such sheets, employing a frame structure supporting infeed roll means and guide structure for receiving sheets from the host machine for feeding them to a receiver tray. The receiver tray is supported within the frame structure for vertical downward and upward movement, as the weight of sheets received increases or decreases. Means are provided for reciprocating the frame structure, together with the infeed rolls and tray transversely of the direction of the sheets supplied from the host machine at intervals such that the sheets are received in sets which are laterally displaced from one another, as a function of the reciprocation of the frame structure.

With such a self contained stacker assembly, the assembly constitutes a substitute for the normal catch tray utilized to receive sheets from the host unit.

Other details, features and advantages of the invention will be understood from the following description with reference to the drawings forming a part hereof.

BRIEF DESCRIPTIONS OF THE DRAWINGS

DESCRIPTION OF THE PREFERRED EMBODIMENT

Figure 1:
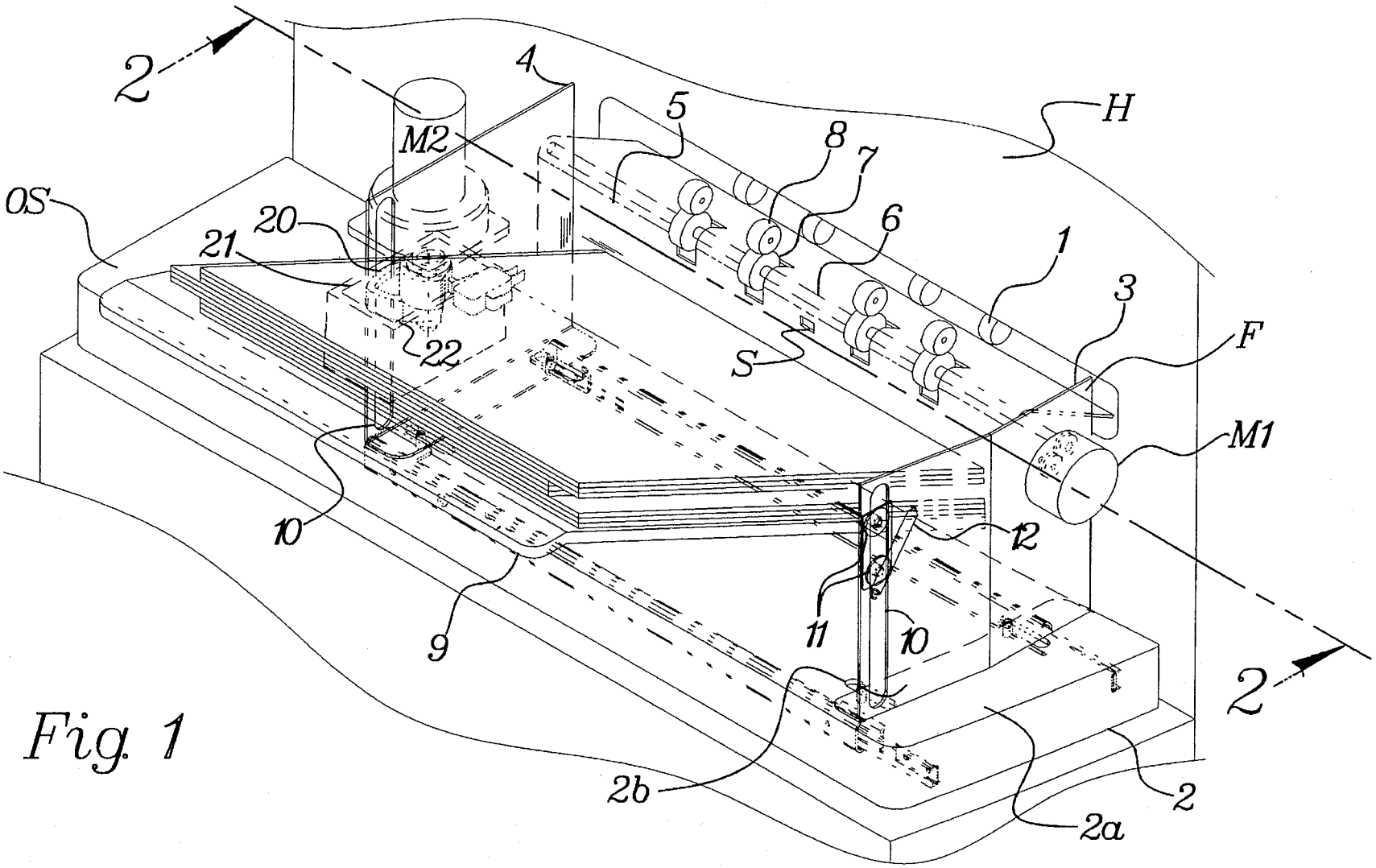
FIG. 1 is a perspective view illustrating the offset stacker of the invention with covers removed.

As seen in the drawings, a host machine such as an office copier or printer has a sheet outlet including output rolls 1 adapted to feed sheets from the host to the usual catch tray or other sorter, stacker or the like.

According to the present invention, the offsetting stacker OS is shown as including a suitable base support 2 positioned to receive sheets emanating from the sheet output of the host machine on which a frame structure F is mounted. The frame structure F is adapted to move on the base support 2 in a reciprocating fashion relative to the sheet outlet of the host machine H.

Frame structure F includes right and left side walls 3 and 4 and a rear wall 5. Extended between the side walls 3 and 4 and integrated with the rear wall 5 is a sheet transport mechanism including a rotary drive shaft 6 on which sheet feeding drive rolls 7 are mounted and with which nip rolls 8 cooperate for transporting sheets when received from the sheet outlet of the host machine. A motor M1 mounted on side wall 3 is adapted to drive the feed roll shaft 6 so as to transport sheets over the top of the rear wall 5 so that the sheets will gravitate onto a receiving tray 9 which also extends between the side walls 3 and 4.

The receiver tray 9 is mounted between the side walls 3 and 4 for vertical movement therebetween from an upper position adapted to receive sheets from the sheet infeed to downwardly located positions dependent upon the weight of the sheets of paper supplied to the receiver tray. Accordingly each of the side walls 3 and 4 of the frame has vertically extended slots 10 in which the tray is supported by means of double shoulder bushing units 11 which are adapted to stabilize the disposition of the receiver tray 9 as it moves vertically between the frame side walls 3 and 4.

Coiled tension springs 12 are connected to the bushing units 11 and to the respective side walls providing an upward bias on the receiver tray 9 to normally move the receiving tray upwardly but to permit progressive downward movement of the receiver tray as the springs 12 counter balance the progressive weight of the receiver tray and the paper thereon as the number of sheets increases in order to collect sheets of paper on the receiver tray in sets which are horizontally offset in a direction laterally with respect to the direction of sheet feed, because the frame assembly F is adapted to be reciprocated along the base 2.

Therefore the base 2 which is preferably of sheet metal or plastic molded form has a planar top wall **2*a* provided with elongated slots 2*b* at opposite ends thereof through which extend pins 2*c*. These pins 2*c* support one side 2*d* of a guide or race which is complemental to the other side 2*e* of a fixed guide or race extending lengthwise of the base 2** so as to guide the frame structure F as it reciprocates transversely of the direction of sheet infeed.

Figure 2:
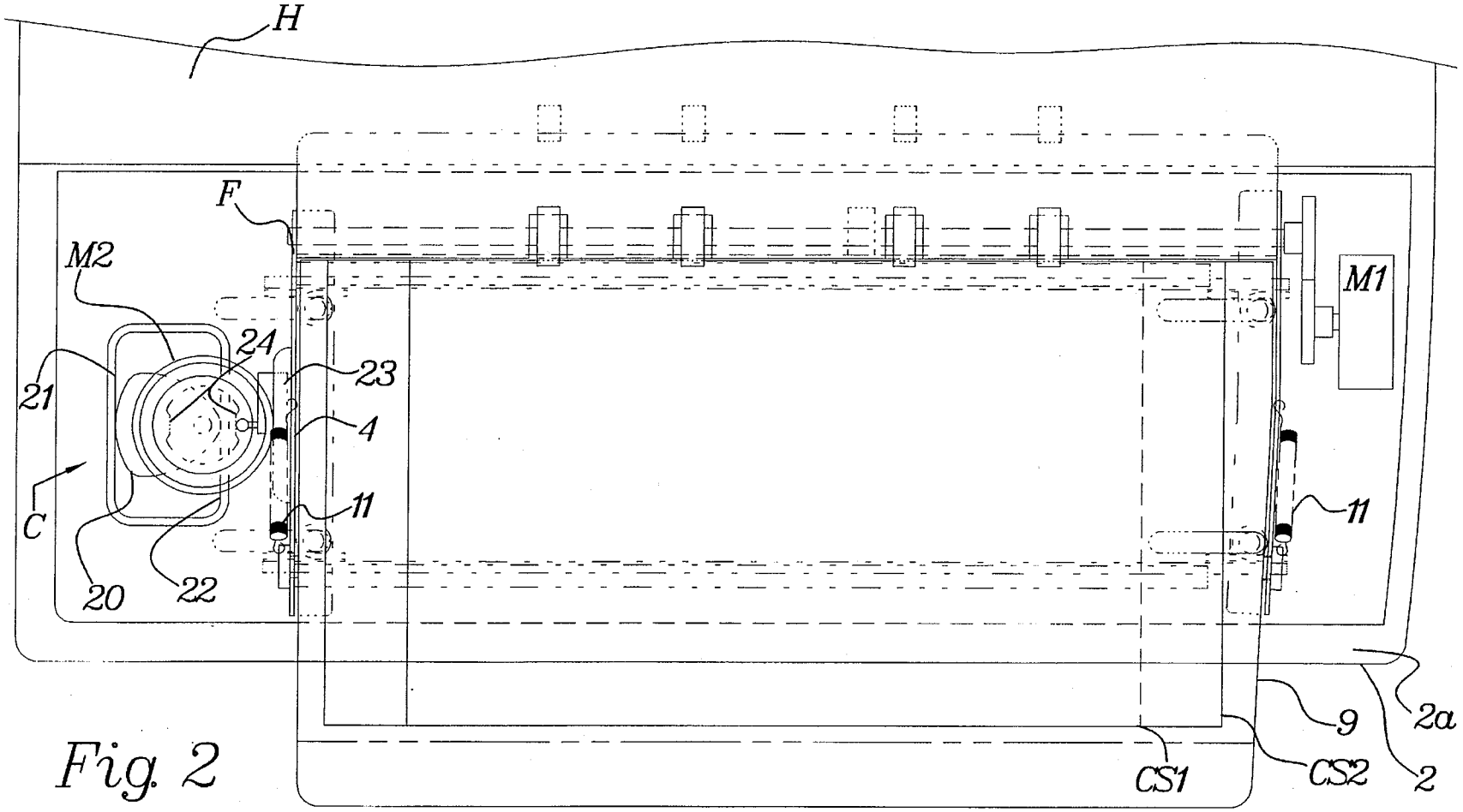
FIG. 2 is a horizontal section on the line 2—2 of FIG. 1 with the tray in one offset position.
Figure 4:
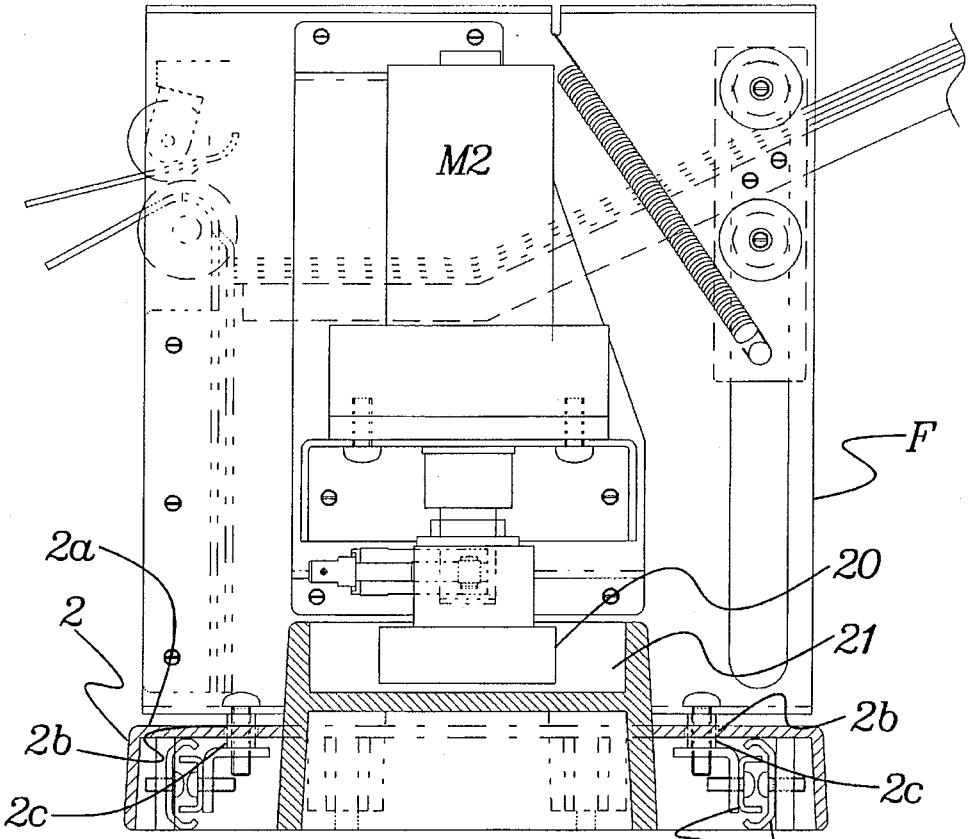
FIG. 4 is vertical section as viewed on the line 4—4 of FIG. 3.

As best seen in FIGS. 2 and 4, above the top wall 2*a* of base support 2 cam means C are provided operable to effect reciprocating movement of the frame structure F along the base support 2. Preferably this cam means, as shown, is a constant breadth circular are cam cooperative with fixed distance followers at opposing sides of the cam for causing reciprocation between the base support and the frame structure, the cam being designated 20 and the fixed distance followers being designated 21 and 22. Cam 20 is adapted to be rotatively driven by a suitable electric motor M2, the operation of which is controlled by a switch 23 and a switch actuator on the cam 20 having diametrically spaced notches 24 so that the cam is rotated 180 degrees upon each energization of the motor M2.

In the form shown, the cam means is operatively associated with the base support 2 and the end wall 4 of the frame structure by providing a mount on wall 4 for the motor drive for the rotary cam and by providing the follower on the top of the base plate.

Figure 3:
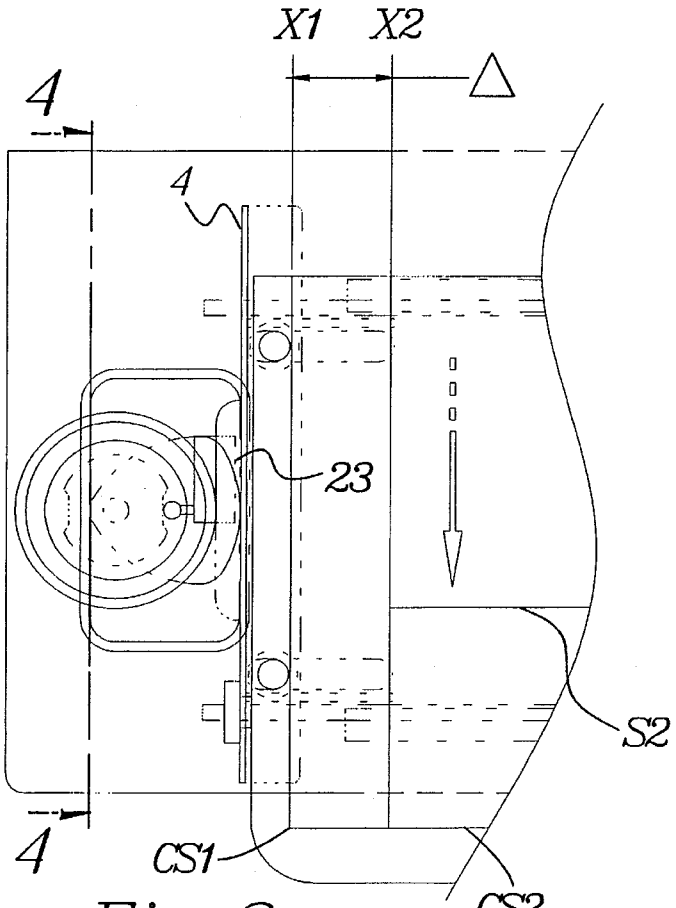
FIG. 3 is a fragmentary view corresponding to FIG. 2 showing the tray in the other offset position.

Accordingly as seen in FIGS. 2 and 3 a first set of sheets CS1 is received on the receiver tray a distance X1 from the side wall 4 of the frame when the frame is in the position shown in FIG. 2, but upon ½ revolution of the cam means 20, the second set of sheets CS2 will be deposited on top of the first set CS1 in a position laterally offset from the direction of travel of the sheet onto the tray by the distance X2 shown in FIG. 3 when the cam means 20 is in the position of FIG. 3 so that the sheets are offset by the delta between X1 and X2.

As seen in FIG. 1, it is preferred that a photosensor S is located in the rear wall 5 to detect the existence of an excess of sheets or sets of sheets on the receiver tray.

Figure 5:
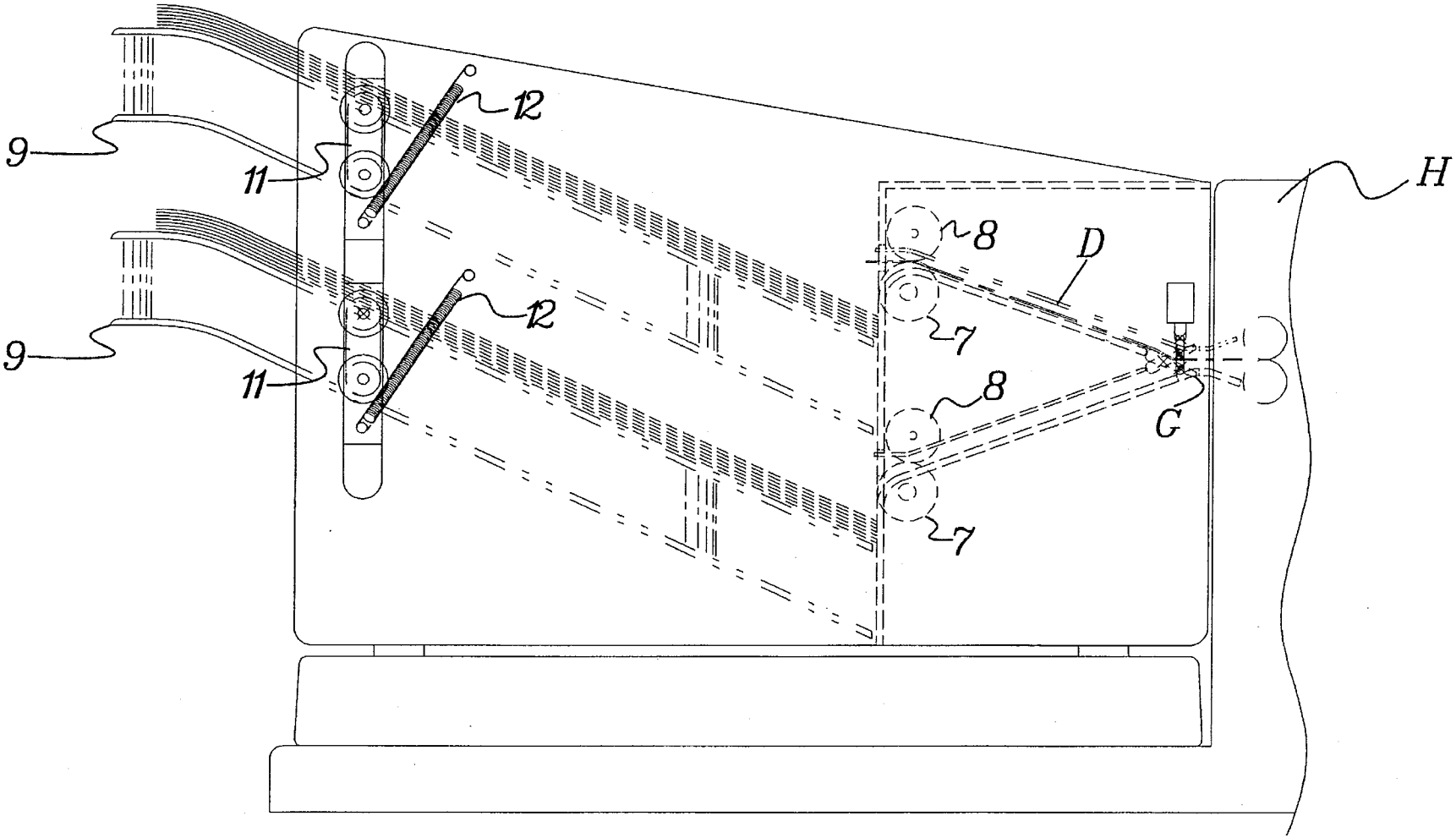
FIG. 5 is a view showing a modified version of the invention in which a pair of offset stacker trays are employed together with means for gating sheets to the selected tray.

Referring to FIG. 5 a modified construction is illustrated wherein a pair of receiver trays 9 are supported between the side walls and independently supported on the respective double bushing units 11 and counter balanced by the separate springs 12.

In addition, a diverter mechanism D is incorporated between the host unit H and separate vertically spaced feed rolls 7 and nip rolls 8. A diverter gate G is employed operable by a suitable solenoid to divert sheets to the upper tray or the lower tray.

From the foregoing it will be apparent that the present invention provides a simple, self contained offset catch tray or sheet receiver which is ideally suited to application to host units not otherwise provided with sophisticated receiver mechanisms such as those disclosed in the prior art.

We claim:

1. An offset stacker tray assembly for receiving sheets from a sheet output of a printer or copier comprising: a base support adapted to be positioned adjacent to the sheet output, a frame structure including vertical side walls and mounted on said base support for reciprocation transversely of the direction of delivery of sheets from said sheet output, a receiver tray supported by said frame structure between said side walls for vertical movement and adapted to receive sheets supplied from said sheet output, means for counter balancing the weight of sheets of paper on said receiver tray normally maintaining said receiver tray in an upper position between said side walls of said frame structure and permitting downward movement of the receiver tray responsive to the weight of sheets of paper thereon, and means coacting between said base support and said frame structure for shifting said frame structure transversely as aforesaid, sheet feeding means carried by said frame structure and extended between said side walls for transverse movement therewith for feeding sheets received from said sheet output to said receiver tray, whereby reciprocation of said frame structure causes sheets fed to said tray by said sheet feeding means to be disposed on said receiver tray in offset relation.

2. An offset stacker assembly as defined in claim 1, wherein said base support has a planar top wall having transversely spaced elongated slots, said frame structure having guide members extending through said slots, and said base support having elongated guides below said planar top for guiding the transverse movement of said frame structure.

3. An offset stacker assembly as defined in claim 1, wherein said means coacting between said base support and said frame structure comprises rotary cam means mounted on one of said side walls of said frame structure and follower means on said base.

4. An offset stacker assembly as defined in claim 3, wherein said rotary cam means comprises a constant breadth circular arc cam cooperative with a pair of fixed distance followers at opposite sides of said cam.

5. An offset stacker assembly as defined in claim 1, wherein said side walls of said frame structure are provided with vertically extended slots, and including means for supporting said receiver tray in said vertically extended slots for vertical movement.

6. An offset stacker assembly as defined in claim 5, wherein said counter balancing means comprises tension springs connected to said side walls and to said means for supporting said receiver tray for vertical movement in said slots.

* * * * *